United States Patent [19]

Bandyopadhyay et al.

[11] 3,978,920

[45] Sept. 7, 1976

[54] IN SITU COMBUSTION PROCESS FOR MULTI-STRATUM RESERVOIRS

[75] Inventors: Pratip Bandyopadhyay; Vaughan W. Rhoades, both of Tulsa, Okla.

[73] Assignee: Cities Service Company, Tulsa, Okla.

[22] Filed: Oct. 24, 1975

[21] Appl. No.: 625,416

[52] U.S. Cl. ..... 166/258; 166/261; 166/245

[51] Int. Cl.[2] ..... E21B 43/24

[58] Field of Search ..... 166/258, 261, 256, 245

[56] References Cited

UNITED STATES PATENTS

| | | | |
|---|---|---|---|
| 3,159,215 | 12/1964 | Meldau et al. | 166/258 |
| 3,196,945 | 7/1965 | Craig, Jr. et al. | 166/261 |
| 3,208,519 | 9/1965 | Moore | 166/261 |
| 3,332,480 | 7/1967 | Parrish | 166/245 |
| 3,334,687 | 8/1967 | Parker | 166/245 |
| 3,361,201 | 1/1968 | Howard | 166/261 X |
| 3,369,601 | 2/1968 | Bond et al. | 166/261 X |
| 3,565,174 | 2/1971 | Parker et al. | 166/261 |
| 3,872,924 | 3/1975 | Clampitt | 166/261 |

*Primary Examiner*—Stephen J. Novosad
*Attorney, Agent, or Firm*—A. Joe Reinert

[57] ABSTRACT

In a combustion process for recovering hydrocarbons from a subterranean hydrocarbon-bearing formation comprising an upper permeable hydrocarbon-bearing stratum overlying a lower permeable hydrocarbon-bearing stratum and separated therefrom by a semi-permeable stratum which is substantially permeable to oxygen but not substantially permeable to water; the strata are traversed by injection and production wells, the lower hydrocarbon-bearing stratum is ignited near an injection well and oxygen-containing gas is injected into the lower hydrocarbon-bearing stratum to combust hydrocarbons near the injection well and form a combustion front, an oxygen-containing gas is injected into the lower hydrocarbon-bearing stratum and an aqueous fluid is injected into the upper hydrocarbon-bearing stratum to move the combustion front between the injection and the production wells and to prevent or mitigate channeling through the upper hydrocarbon-bearing stratum, and hydrocarbons are recovered from the strata.

10 Claims, 2 Drawing Figures

IN SITU COMBUSTION PROCESS FOR MULTI-STRATUM RESERVOIRS

BACKGROUND OF THE INVENTION

1. Field of the Invention

This invention relates to improved recovery of hydrocarbons from a subterranean formation by a combustion process (Fireflooding). In one aspect, the invention relates to an improved combustion process wherein the improvement involves prevention and/or mitigation of channeling of combustion front movement from a lower permeable hydrocarbon-bearing stratum through a semi-permeable stratum and through an upper permeable hydrocarbon-bearing stratum between an injection well and a production well wherein the improvement comprises injecting an aqueous fluid selectively to the upper hydrocarbon-bearing stratum and injecting an oxygen-containing gas selectively into the lower hydrocarbon-bearing stratum.

2. Brief Description of the Prior Art

A great need exists for increased production of hydrocarbons to meet increasing demands in the face of rapidly depleting reserves. One of the more promising approaches to providing for this need involves enhanced recovery methods. Thermal recovery methods, in particular, in situ combustion methods, provide one means for recovering vast reserves of heavy petroleum deposits including tar sands and other reservoirs containing high viscosity materials which are not economically recoverable by other means.

U.S. Pat. No. 3,208,519; 2,994,375; 3,406,755; 3,159,215; 3,170,515; 3,024,841; 3,196,945; and 3,171,479 are exemplary disclosures of meritorious processes for recovery of heavy hydrocarbons by thermal methods, in particular in situ combustion methods (Fireflooding), which are particularly related to the instant invention.

Thus, it is known to recover hydrocarbons from a hydrocarbon-bearing subterranean formation, in particular a heavy oil reservoir or tar sand, by penetrating the formation with a production well and an injection well, igniting the hydrocarbons in the deposit, injecting air to cause burning of a portion of the hydrocarbons in situ, and recovering hydrocarbons which are reduced in viscosity by the heat generated by the burning. Processes involving forward combustion wherein an oxygen-containing gas is injected into an injection well causing forward burning in the direction of a production well are known. Also known are reverse combustion processes wherein combustion is initiated in a production well with oxygen-containing gas injection from an injection well and movement of the firefront from the production to the injection well and production of hydrocarbons from the production well. It is also known to enhance the effectiveness of such fireflood processes by introduction of water into proximity with the burning zone. It is further known (U.S. Pat. No. 3,208,519) to inject water near the upper portion of a hydrocarbon-bearing stratum wherein both water and air are injected through an injection well to move a firefront from an injection well to a production well. It is also known to inject water through an injection well into an upper hydrocarbon-bearing stratum while air is injected into a lower permeable hydrocarbon-bearing stratum through an injection well to move a combustion front through the lower stratum wherein both strata are separted by an impervious shale stratum (U.S. Pat. No. 3,159,215).

Advantageous and valuable though such processes are, such do not completely fulfill the need for an efficient method of recovering hydrocarbons from hydrocarbon-bearing reservoirs wherein an upper permeable hydrocarbon-bearing stratum overlies a lower hydrocarbon-bearing permeable stratum and is separated therefrom by a semi-permeable stratum which is substantially permeable to oxygen but not substantially permeable to water. Our improvement invention provides a substantial advance in recovering hydrocarbons from hydrocarbon-bearing strata in reservoirs of the type described.

OBJECTS OF THE INVENTION

An object of the invention is to provide an improved combustion process for the recovery of liquid hydrocarbons from hydrocarbon-bearing subterranean formations.

This and other objects, advantages, and features of the invention will become apparent to those skilled in the art from a reading of the following detailed description.

SUMMARY OF THE INVENTION

According to the present invention, we have found an improved method for recovering liquid hydrocarbons from a hydrocarbon-bearing subterranean formation wherein the formation comprises an upper permeable hydrocarbon-bearing stratum overlying a lower permeable hydrocarbon-bearing stratum and wherein the hydrocarbon-bearing strata are separated by a semi-permeable stratum which is substantially permeable to oxygen but not substantially permeable to water. Our invention involves combusting a portion of the hydrocarbons in the formation. According to our invention, the lower hydrocarbon-bearing stratum is ignited near the locus of the injection well, and oxygen-containing gas is injected into the lower hydrocarbon-bearing stratum to combust the hydrocarbons in the locus of the injection well and form a combustion front, an oxygen-containing gas is injected into the lower hydrocarbon-bearing stratum and an aqueous fluid is injected into the upper hydrocarbon-bearing stratum to maintain and move the combustion front between the injection well and the production well and to prevent or mitigate channeling through the upper hydrocarbon-bearing stratum.

DESCRIPTION OF THE PREFERRED EMBODIMENTS

Figure 1:
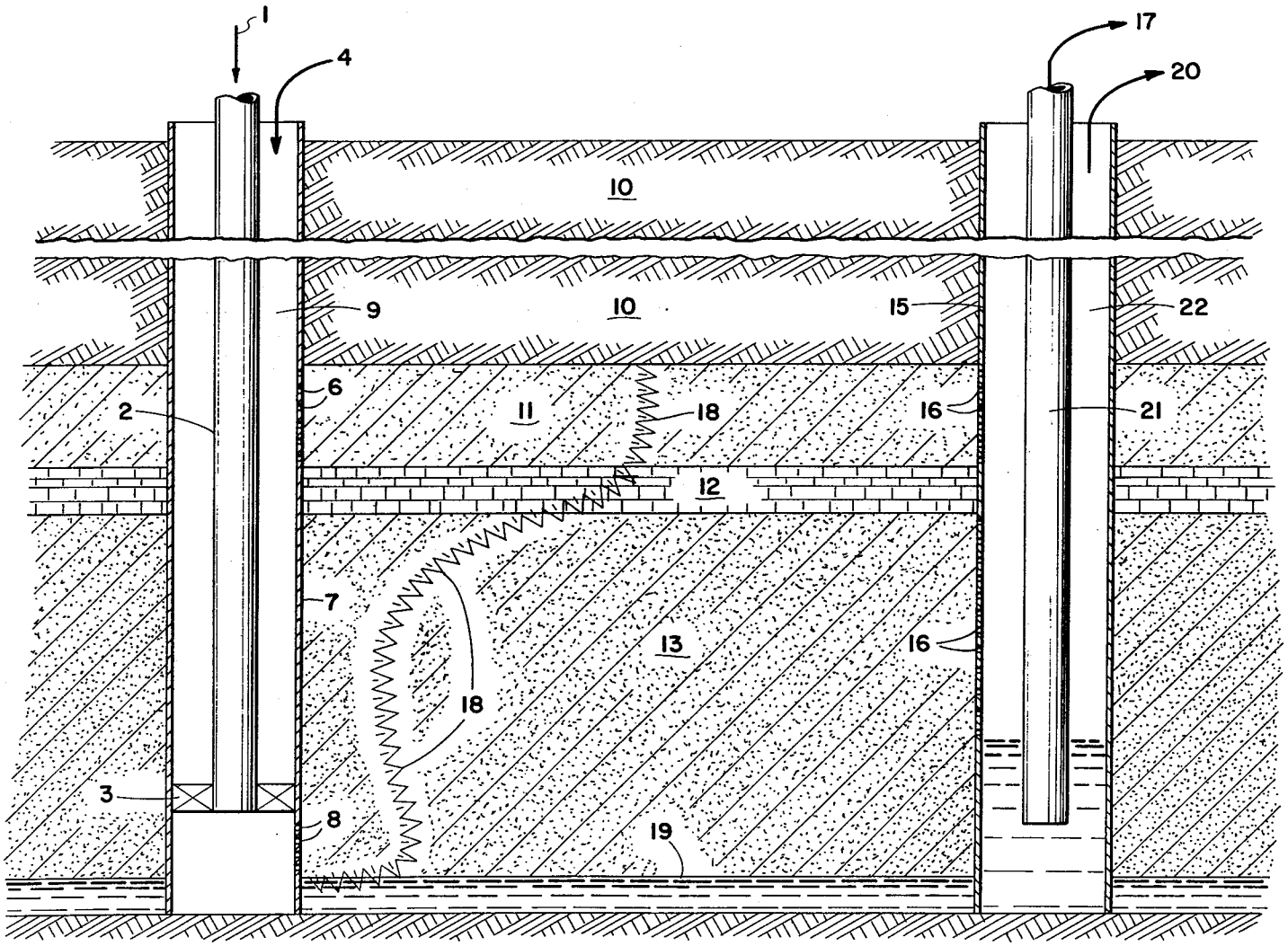
FIG. 1 is a side elevational view illustrating one simplified embodiment of the invention at a point in time before injecting an oxygen-containing gas into the lower hydrocarbon-bearing stratum and an aqueous fluid into the upper hydrocarbon-bearing stratum.
Figure 2:
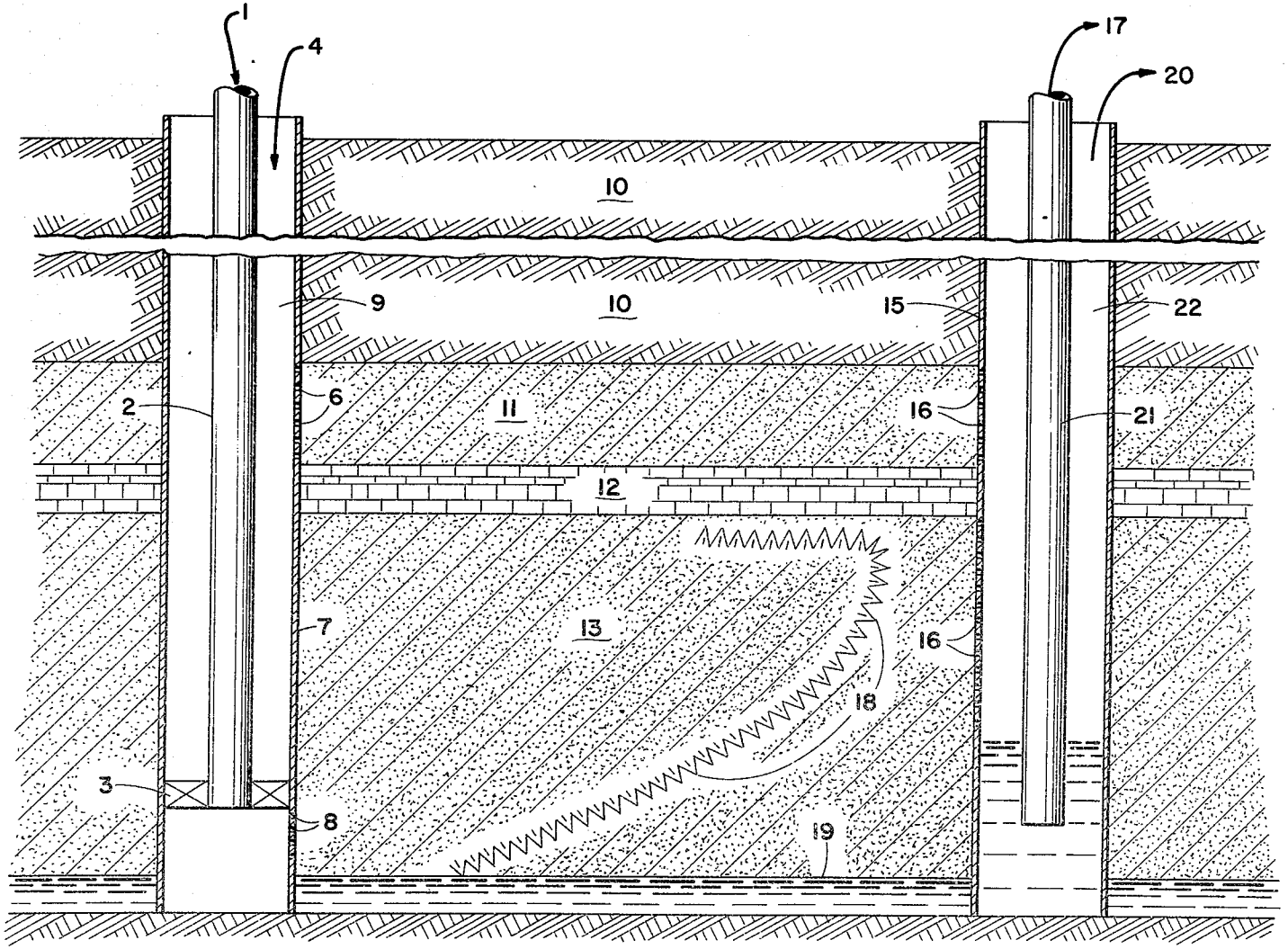
FIG. 2 is a side elevational view illustrating the simplified embodiment of the invention at a point in time following injection of an oxygen-containing gas into the lower hydrocarbon-bearing stratum and an aqueous fluid into the upper hydrocarbon-bearing stratum.

Referencing FIGS. 1 and 2, the following description of a presently preferred mode of operation is provided.

Thus, according to FIG. 1, a subterranean hydrocarbon-bearing formation, comprising an upper permeable hydrocarbon-bearing stratum 11 overlying a lower permeable hydrocarbon-bearing stratum 13 and separated therefrom by a semi-permeable stratum 12 which is substantially permeable to oxygen but not substantially permeable to water, wherein the hydrocarbon-bearing formation is overlain by overburden 10 and underlain by basement formation 14, is vertically traversed by an injection well 7 and a production well 15.

The injection well 7 has perforation 6 providing fluid communication into the upper permeable hydrocarbon-bearing stratum 11 and perforations 8 providing fluid communication into the lower hydrocarbon-bearing stratum. An injection conduit 2 reaches from the surface to the locus of the lower permeable hydrocarbon-bearing stratum forming an annulus 9 between the injection conduit and the casing of the injection well. Fluid communication for injecting fluids 1 through the conduit 2 into the lower hydrocarbon-bearing stratum 13 through perforations 8 is separated from fluid communication for injecting fluids 4 into the upper hydrocarbon-bearing stratum 11 by a packer 3.

The casing of the production well 15 has perforations 16 providing fluid communication between the well and both the upper permeable hydrocarbon-bearing stratum 11 and the lower hydrocarbon-bearing stratum 13 for production of liquids 17 through production conduit 21 and gases 20 through annulus 22. A water-bearing portion 19 of the lower permeable hydrocarbon-bearing stratum lies below the hydrocarbon deposit.

The same numbering system applies to features in FIG. 2.

According to one presently preferred mode of operation, the upper hydrocarbon-bearing stratum and the lower hydrocarbon-bearing stratum are ignited in the locus of perforations 6 and 8. Thereupon, an oxygen-containing gas is injected as fluids 1 and 4 through the annulus 9 and the conduit 2 into the strata 11 and 13. A combustion or fire front 18 moves from the injection well to the production well and assumes a configuration such as that shown in FIG. 1.

Thereupon, the fluid 4 injected through the annulus into the upper stratum 11 is switched from an oxygen-containing gas such as air to an aqueous fluid such as water.

The effect is to cool the upper permeable stratum and extinguish the firefront therein while sweeping mobilized fluids including hydrocarbons therefrom utilizing the heat of the firefront therein. A further effect is to cool the upper portion of the lower permeable stratum 13 and alter the shape of the combustion front to greatly enhance recovery from the lower stratum and prevent premature breakthrough by channeling through the upper stratum. The firefront in the lower stratum thereupon assumes a configuration exemplified in FIG. 2. Produced fluids 17 are produced from the production well resulting in considerably enhanced recovery from both hydrocarbon-bearing strata.

According to another presently preferred mode, the process of this invention wherein a plurality of production wells through which liquid hydrocarbons and gaseous products of combustion are produced is further enhanced as to sweep effectiveness by throttling the production wells to increase the steam pressure in the locus ahead of the combustion zone, and the combustion front advance is controlled by selectively throttling and increasing gas pressure of production wells in the vicinity of the greatest advance of the combustion front. Detailed teaching of this embodiment is found in our application Ser. No. 619,726 filed on Oct. 6, 1975, entitled Improving Oil Recovery Rate by Throttling Production Wells During Combustion Drive.

Typically an advancing forward combustion front passing through a reservoir of the type to which our invention relates will have distinct fronts or zones associated with it which phase from the undisturbed reservoir to a burn zone following it. The usual sequence is: undisturbed zone, oil zone, water zone, condensing steam zone, coking zone, combustion zone, and burned zone. Of course, these zones in practice merge into each other. Reverse combustion has an analogous sequence of zones or fronts which are well known to those skilled in the art. For convenience and simplification of the drawing, the totality of these fronts or zones is shown in FIGS. 1 and 2 as the firefront 18, though it should be understood that this simplification designation can include any combination of the zones associated with a combustion-type process.

Though the improved process of our invention can be employed in reverse combustion, that is, wherein an oxygen-containing gas is injected into an injection well and hydrocarbons are produced from the production well with the combustion front moving from the production well to the injection well, it is most advantageously employed in a forward combustion mode, that is, wherein an oxygen-containing gas is injected into an injection well and hydrocarbons are recovered from a production well with movement of the firefront from the injection well toward the production well.

In the reverse combustion mode, the most advantageous application is in a line-drive configuration wherein a plurality of both production and injection wells are employed.

In the forward combustion mode wherein an oxygen-containing gas is injected into an injection well and hydrocarbons are produced from a production well, inverted five-spot, inverted nine-spot, and line-drive configurations are presently preferred modes of operation.

In an inverted five-spot mode of operation, the injector well is the center well of the five-spot, and production wells comprise the other four spots of the configuration which resembles the configuration on dominos or dice from an overhead view. In other words, the injection well is in the center of a square, from an overhead view, with the four production wells lying in the corners of the square.

The inverted nine-spot mode of operation is similar to the inverted five-spot, that is, the injection well lies in the center of a square from an overhead view, with four production wells lying in the corners of the square and four more production wells each lying in a line between two corner wells.

In the line-drive mode of operation, a plurality of injection wells are employed to inject an oxygen-containing gas into the strata causing advance of a firefront in a more or less straight line toward a plurality of production wells in a more or less straight line parallel to a line intersecting the plurality of injection wells.

Following the stage of operation wherein the aqueous fluid is injected into the upper hydrocarbon-bearing stratum and the oxygen-containing gas is injected into the lower hydrocarbon-bearing stratum, injection into the lower stratum according to a presently preferred mode of operation involves injecting water along with the oxygen-containing gas either concurrently, in sequence, or in combination of in sequence and concurrently.

The oxygen-containing gas can be air, pure oxygen, or mixtures of oxygen and other gases. In one aspect, enriched air having about 80 percent oxygen content is advantageously employed. In another aspect, air is injected as the oxygen-containing gas.

For most effective operation, it is desirable that the hydrocarbon-bearing strata have a thickness of at least about 10 feet and a permeability of at least about 50 millidarcies.

Ignition of the hydrocarbon-bearing strata can be effected with a gas-fired burner, electric heater, or any other conventional means.

Typically the temperature of the combustion zone will be on the order of 1,000°F with the temperature falling off on either side of the firefront down to the ambient temperature of the reservoir. Combustion zone temperatures can typically range from about 500° to about 1500°F.

Injection air pressure and injection water pressure are largely governed by a formation permeability, depth, and other reservoir characteristics. The pressure of air and water will normally vary from about 50 to about 3000 psig at the injection well. Maximum allowable pressure, of course, is the fracture pressure of the formation.

Optimum ratios of oxygen-containing gas to water, sequence of the injections, pressures of injection, well spacing, and the like, following starting of injection of aqueous fluid into the upper stratum can be as well known to those skilled in the art or can be readily calculated and determined by skilled engineers with routine experimentation and use of his skill not amounting to invention.

In combustion operations of the type to which our invention pertains, liquid hydrocarbons are normally produced from a production well through a pipe reaching from the surface to near the bottom of the well while gases such as combustion gases including oxygen, carbon dioxide, and carbon monoxide are produced through the well annulus between the casing and the pipe employed to produce the hydrocarbons and other liquid fluids.

In order to more fully explain the present invention, the following exemplary description of how to carry it out is provided. However, it is to be understood that this example is not intended to function as a limitation on the invention as described and claimed herein.

To illustrate the invention, a center injection well and four outlying production wells in an inverted five-spot configuration are drilled and completed into a formation at about 600 feet of depth as into the Bellevue reservoir near Bellevue, La. The reservoir is comprised of an upper hydrocarbon-bearing stratum which is about 20 feet thick and a lower permeable hydrocarbon-bearing stratum which is about 40 feet thick. The two strata are separated by a limestone stratum which is substantially permeable to oxygen but not substantially permeable to aqueous fluid. The hydrocarbon-bearing strata contains 19° API gravity heavy bituminous petroleum having a temperature of about 70°F, and the lower stratum has a lower zone containing aqueous reservoir fluids.

The production wells are completed with perforation in both hydrocarbon-bearing strata. The injection well is completed according to the configuration shown in FIGS. 1 and 2.

Upon completion, air injection and ignition of the hydrocarbon-bearing strata is effected in the injection well. Following a burning period of several days, injection of air into the upper hydrocarbon-bearing stratum is terminated and water is injected instead. Thereupon, injection of water into the upper hydrocarbon-bearing stratum and air into the lower hydrocarbon-bearing stratum is continued with production of hydrocarbons and other fluids from the production wells.

Considerably enhanced recovery is effected in comparison to a similar operation wherein air injected into the strata demonstrating the considerably improved process.

What is claimed is:

1. In a subterranean hydrocarbon-bearing formation comprising an upper permeable hydrocarbon-bearing stratum overlying a lower permeable hydrocarbon-bearing stratum and separated therefrom by a semi-permeable stratum which is substantially permeable to oxygen but not substantially permeable to water; a process for recovering the hydrocarbons from the hydrocarbon-bearing strata comprising;

a. vertically traversing the strata with an injection well and a production well, b. igniting the lower hydrocarbon-bearing stratum at the locus of the injection well, c. injecting an oxygen-containing gas into the lower hydrocarbon-bearing stratum to combust the hydrocarbon therein at the locus of the injection well and to form a combustion front, d. injecting an oxygen-containing gas into the lower hydrocarbon-bearing stratum and an aqueous fluid into the upper hydrocarbon-bearing stratum to maintain and move the combustion front between the injection well and the production well and to prevent or mitigate channeling through the upper hydrocarbon-bearing stratum, and e. recovering hydrocarbons from the hydrocarbon-bearing strata.

2. In a subterranean hydrocarbon-bearing formation comprising an upper permeable hydrocarbon-bearing stratum overlying a lower permeable hydrocarbon-bearing stratum and separated therefrom by a semi-permeable stratum which is substantially permeable to oxygen but not substantially permeable to water; a process for recovering the hydrocarbons from the hydrocarbon-bearing strata comprising:

a. vertically traversing the strata with an injection well and a production well, b. igniting the upper hydrocarbon-bearing stratum and the lower hydrocarbon-bearing stratum at the locus of the injection well, c. injecting an oxygen-containing gas into the upper hydrocarbon-bearing stratum and the lower hydrocarbon-bearing stratum to combust hydrocarbons therein near the locus of the injection well thereby forming a combustion front, d. thereupon injecting an oxygen-containing gas into the lower hydrocarbon-bearing stratum and an aqueous fluid into the upper hydrocarbon-bearing stratum to move the combustion front through the lower hydrocarbon-bearing stratum from the injection well to the production well and to move produced fluids from the injection well to the production well, and e. recovering hydrocarbons from the strata by means of the production well.

3. The process of claim 2 wherein the injection well is a center well of an inverted five-spot configuration and a plurality of production wells are employed.

4. The process of claim 2 wherein the injection well is a center well in an inverted nine-spot configuration and a plurality of production wells are employed.

5. The process of claim 2 wherein a plurality of injection wells and a plurality of production wells are employed in a line-drive configuration.

6. The process of claim 2 wherein both air and an aqueous fluid are injected into the lower hydrocarbon-bearing stratum through the injection well.

7. The process of claim 6 wherein the water injected into the lower hydrocarbon-bearing stratum is injected subsequent to a period of combustion maintained by injection of air into the lower hydrocarbon-bearing stratum through the injection well.

8. The process of claim 6 wherein the injection well is the center well of an inverted nine-spot configuration.

9. The process of claim 6 wherein the injection well is the center well of an inverted five-spot configuration.

10. The process of claim 2 wherein the process is employed to recover hydrocarbons from the Bellevue reservoir near Bellevue, La.

* * * * *